US012716149B2

(12) United States Patent
Gruben et al.

(10) Patent No.: US 12,716,149 B2
(45) Date of Patent: Aug. 25, 2026

(54) MOISTURE CONDITIONER WITH SLATS FOR COTTON PROCESSING

(71) Applicant: Cotton Picking Mind Limited Partnership, Lubbock, TX (US)

(72) Inventors: William D. Gruben, Abilene, TX (US); Jeremy J. Osborne, Lubbock, TX (US); S. Christopher Jackson, Lubbock, TX (US)

(73) Assignee: Cotton Picking Mind Limited Partnership, Lubbock, TX (US)

( * ) Notice: Subject to any disclaimer, the term of this patent is extended or adjusted under 35 U.S.C. 154(b) by 0 days.

(21) Appl. No.: 19/038,064

(22) Filed: Jan. 27, 2025

(65) Prior Publication Data

US 2025/0243608 A1 Jul. 31, 2025

Related U.S. Application Data

(60) Provisional application No. 63/626,597, filed on Jan. 30, 2024.

(51) Int. Cl.
*D01G 99/00* (2010.01)

(52) U.S. Cl.
CPC ..... *D01G 99/005* (2013.01)

(58) Field of Classification Search
CPC ..... D01G 99/005
USPC ..... 19/66 CC
See application file for complete search history.

(56) References Cited

U.S. PATENT DOCUMENTS

| | | | | | |
|---|---|---|---|---|---|
| 5,274 | A * | 9/1847 | Mason | D01G 29/00 | 19/66 R |
| 1,688,524 | A * | 10/1928 | Cobb | D01G 9/00 | 68/5 D |
| 3,136,004 | A * | 6/1964 | Smith | D01G 9/20 | 19/95 |
| 3,559,804 | A * | 2/1971 | Lytton | D01G 9/00 | 19/205 |
| 4,103,397 | A * | 8/1978 | Jackson | D01B 1/04 | 19/66 CC |
| 5,381,587 | A * | 1/1995 | Vandergriff | D01B 1/06 | 19/48 R |
| 6,314,618 | B1 * | 11/2001 | Mehner | D01B 1/04 | 19/48 R |

(Continued)

FOREIGN PATENT DOCUMENTS

DE 3333618 A1 * 4/1985 ..... D01G 9/20

*Primary Examiner* — Shaun R Hurley
(74) *Attorney, Agent, or Firm* — Dickinson Wright PLLC; Mark E. Scott

(57) ABSTRACT

The specification describes a moisture conditioner with slats. At least one example is a method of supplying moisture to fibrous material, the method comprising: feeding a batt of fibrous material into an annular channel between a cylindrical drum that is rotating and set of louvers that are stationary, the set of louvers defining a drum side and a plenum side; moving the batt of fibrous material along a path of travel between an outside diameter of the cylindrical drum and the drum side of the set of louvers; feeding moist air to the plenum side of the set of louvers; directing, by the set of louvers, the moist air along the path of travel and into the batt of fibrous material; and after the moist air passes through the batt of fibrous material, drawing moist air into the cylindrical drum.

19 Claims, 5 Drawing Sheets

(56) References Cited

U.S. PATENT DOCUMENTS

| | | | | |
|---|---|---|---|---|
| 2002/0088590 | A1* | 7/2002 | Latham | D01G 99/005<br>162/207 |
| 2009/0100643 | A1* | 4/2009 | Mehner | D01B 1/02<br>19/48 R |

* cited by examiner

MOISTURE CONDITIONER WITH SLATS FOR COTTON PROCESSING

CROSS-REFERENCE TO RELATED APPLICATIONS

This application claims the benefit of U.S. Provisional App. No. 63/626,597 filed Jan. 30, 2024 and titled, "Moisture Conditioner with Slats for Cotton Processing." The provisional application is incorporated by reference herein as if reproduced in full below.

FIELD

The present disclosure relates to devices and methods for processing lint cotton or other fibrous materials. More specifically, the present disclosure pertains to devices and methods for providing moisture to lint cotton during processing.

BACKGROUND

Providing moisture to lint cotton in a cotton gin provides many benefits. For example, cotton is most often bought and sold on a per-pound basis, and humidifying lint cotton increases the weight of the cotton. Further, providing moisture improves operation of the bale press. In particular, moist lint cotton needs lower compaction force and less compaction time within the press box. Oppositely, dry lint cotton needs higher compaction force and more compaction time in the press box. Higher compaction force requires higher energy consumption, and causes excess wear and tear on the bale press components.

One method of humidifying lint cotton is by exposing the cotton to a stream of warm, humid air. For example, U.S. Pat. No. 6,314,618, issued to Jackson-Charter LP, discloses a moisture conditioner for lint cotton. The moisture conditioner of the '618 Patent comprises a rotatable hollow cylinder in operational relationship to a stationary perforated screen. A batt of lint cotton is conveyed along the perforated screen by rotation of the rotatable hollow cylinder. As the batt of lint cotton is conveyed along, a flow of warm, humid air moves through the perforated screen, then through the batt of lint cotton, and then into the rotating hollow cylinder. The direction of travel of the warm, humid air is thus perpendicular to the direction of travel of the batt of lint cotton.

However, using a perforated screen as the stationary component of a moisture conditioner has drawbacks. For example, pin trash falls through the perforated screen and into the air plenum beneath. The collected pin trash causes considerable build-up and blockages. The blockages created by the pin trash must be periodically cleared, which periodic clearing causes operational delays and significant down time of the cotton gin. Moreover, the pin trash may snag or catch in the perforated screen and protrude in the flow area of the lint cotton, creating a surface resistant to the movement of the batt of lint cotton.

SUMMARY

One example is a method of supplying moisture to fibrous material, the method comprising: feeding a batt of fibrous material into an annular channel between a cylindrical drum that is rotating and set of louvers that are stationary, the set of louvers defining a drum side and a plenum side; moving the batt of fibrous material along a path of travel between an outside diameter of the cylindrical drum and the drum side of the set of louvers; feeding moist air to the plenum side of the set of louvers; directing, by the set of louvers, the moist air along the path of travel and into the batt of fibrous material; and after the moist air passes through the batt of fibrous material, drawing moist air into the cylindrical drum.

In the example method, wherein directing the moist air along the path of travel may comprise flowing the moist air through flow channels defined between louvers of the set of louvers.

In the example method, wherein directing the moist air along the path of travel may comprise, at a location of each louver of the set of louvers, directing the moist air along a tangent to the path of travel.

In the example method, wherein directing the moist air along the path of travel may comprise directing the moist air in a direction between and including tangent to the annular channel and minus five (−5) angular degrees with respect to the tangent, the minus ten angular degrees toward an axis of rotation of the cylindrical drum.

In the example method, wherein directing the moist air along the path of travel may comprise, at an angular location of each louver of the set of louvers, directing the moist air in a direction between and including tangent to the annular channel and minus ten (−10) angular degrees with respect to the tangent at each respective angular location, the minus ten angular degrees toward an axis of rotation of the cylindrical drum.

In the example method, wherein moving the batt of fibrous material along the path of travel may comprise at least one selected from a group comprising: drawing the batt of fibrous material against the cylindrical drum based on vacuum applied to an internal volume of the cylindrical drum; and movement of the moist air along the path of travel.

In the example method, wherein the moist air may provide 10 to 14 pounds of moisture per bale of lint cotton processed.

In the example method, wherein feeding the moist air to the plenum side and through louvers may comprise feeding the moist air with a velocity of 1500 feet per minute.

In the example method, wherein the moist air may have an air temperature of between and including 120 to 160 degrees F. dry-bulb and a relative humidity of 70% or above.

In the example method, wherein the moist air may have a relative humidity of 70% or above.

Another example is a moisture conditioner apparatus comprising: a cylindrical drum defined by a screen with a plurality of apertures, the cylindrical drum having a longitudinal central axis and configured to rotate about the longitudinal central axis; a moisture diffuser positioned adjacent to a portion of the cylindrical drum, wherein the moisture diffuser and the cylindrical drum define an annular channel; the moisture diffuser comprises a plurality of slats, each slat having a long dimension parallel to the longitudinal central axis; a plurality of flow nozzles, each flow nozzle formed between adjacent slats, and each flow nozzle configured to direct airflow into the annular channel; a doffer in operational relationship to the cylindrical drum and angularly displaced from the moisture diffuser, the doffer configured to dislodge a batt of fibrous material from the cylindrical drum.

In the example moisture conditioner apparatus, each flow nozzle may reside at a distinct angular location relative to the annular channel, and each flow nozzle may direct airflow into the annular channel along a tangent to the annular channel at each respective angular location.

In the example moisture conditioner apparatus, wherein each flow nozzle may reside at a distinct angular location relative to the annular channel, and each flow nozzle may direct airflow into the annular channel in a direction between and including tangent to the annular channel and minus ten (−10) angular degrees with respect to the tangent at each respective angular location.

The example moisture conditioner apparatus may further comprise an air pump and a suction plenum associated with the cylindrical drum, the air pump and suction plenum configured to place an internal volume of the cylindrical drum under vacuum.

The example moisture conditioner apparatus may further comprise a humidified air source configured to provide the humidified air to the moisture diffuser.

In the example moisture conditioner apparatus, a cross-sectional flow area of the plurality of flow nozzles may be between and including 1.0-2.0 square feet.

In the example moisture conditioner apparatus, each slat of the plurality of slats may have a length of between and including 35 to 65 inches.

In the example moisture conditioner apparatus, each slat of the plurality of slats may have a length of between and including 40 to 60 inches.

The example moisture conditioning apparatus may be coupled between a batt condenser and a lint slide.

Yet another example is a moisture conditioner apparatus comprising: a cylindrical drum defined by a screen with a plurality of apertures, the cylindrical drum having a longitudinal central axis and configured to rotate about the longitudinal central axis; a moisture diffuser positioned adjacent to a portion of the cylindrical drum, wherein the moisture diffuser and the cylindrical drum define an annular channel; the moisture diffuser comprises a plurality of slats parallel to each other, each slat having a long dimension parallel to the longitudinal central axis, and each slat having a width; the width of each slat defines a direction coaxial with a tangent of the annular channel or the cylindrical drum; a plurality of flow nozzles, each flow nozzle formed between adjacent slats; a fluted roller in operational relationship to the cylindrical drum and angularly displaced from the moisture diffuser, the fluted roller configured doff a batt of fibrous material from the cylindrical drum.

BRIEF DESCRIPTION OF THE DRAWINGS

For a detailed description of example embodiments, reference will now be made to the accompanying drawings in which.

DEFINITIONS

Figure 1:
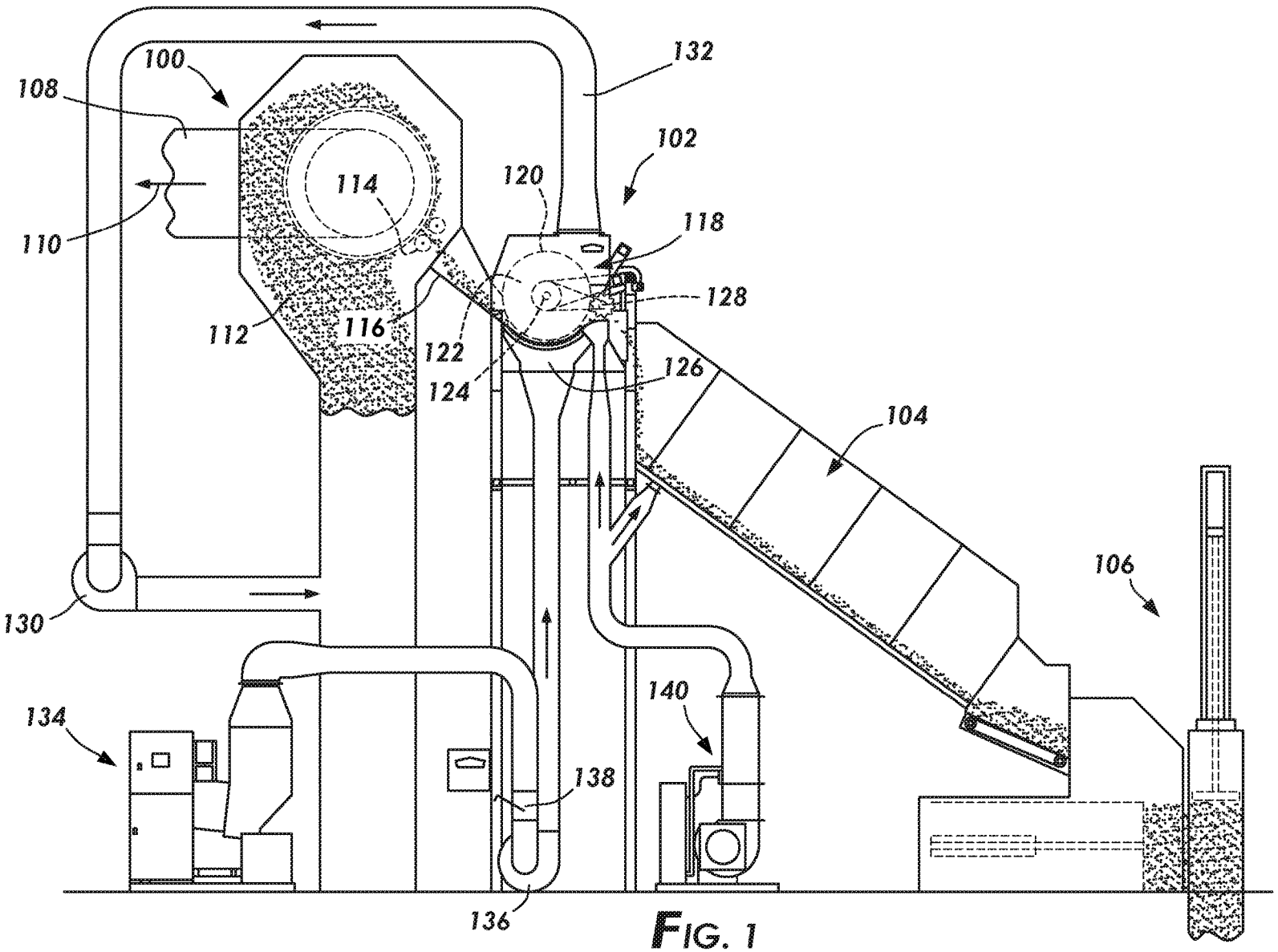
FIG. 1 shows a schematic view of a portion of a cotton gin.

The term "about" is used in conjunction with numeric values to include normal variations in measurements as expected by persons skilled in the art, and is understood to have the same meaning as "approximately" and to cover a typical margin of error, such as ±15%, ±10%, ±5%, ±1%, ±0.5%, or even ±0.1% of the stated value. Whether or not modified by the term "about," the claims include equivalents to the quantities.

It should be noted that, as used in this specification and the appended claims, the singular forms "a," "an," and "the" include plural referents unless the content clearly dictates otherwise. Thus, for example, reference to a composition containing "a compound" includes having two or more compounds that are either the same or different from each other. It should also be noted that the term "or" is generally employed in its sense including "and/or" unless the content clearly dictates otherwise. As used herein, "and/or" refers to and encompasses any and all possible combinations of one or more of the associated listed items, as well as the lack of combinations when interpreted in the alternative ("or").

In the interest of brevity and conciseness, any ranges of values set forth in this specification contemplate all values within the range and are to be construed as support for claims reciting any sub-ranges having endpoints which are real number values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5.

The term "substantially" is utilized herein to represent the inherent degree of uncertainty that can be attributed to any quantitative comparison, value, measurement, or other representation. The term "substantially" is also utilized herein to represent the degree by which a quantitative representation can vary from a stated reference without resulting in a change in the basic function of the subject matter at issue.

The term "comprise," "comprises," and "comprising" as used herein, specify the presence of the stated features, integers, steps, operations, elements, and/or components, but do not preclude the presence or addition of one or more other features, integers, steps, operations, elements, components, and/or groups thereof.

As used throughout this description, and in the claims, a list of items joined by the term "at least one of" or "one or more of" can mean any combination of the listed terms. For example, the phrase "at least one of X, Y or Z" can mean X; Y; Z; X and Y; X and Z; Y and Z; or X, Y and Z.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Various examples are directed to moisture conditioners. More particularly, various examples are directed to moisture conditioners comprising a cylindrical drum that rotates and a stationary structure or moisture diffuser adjacent to a portion of the cylindrical drum. The space between the cylindrical drum and the moisture diffuser defines an annular channel. The moisture diffuser comprises louvers or slats that interface with the annular channel, and the slats define flow nozzles that direct humidified air into the annular channel substantially along respective tangents to the annular channel. Directing the humidified air substantially along tangents to the annular channel increases contact time of the humid air with a batt of fibrous material moving within the annular channel. Moreover, the directing the humidified air substantially along the respective tangent to the annular channel may assist in moving the batt of fibrous material along the annular channel.

The various embodiments were developed in the context of the fibrous material being cotton, and more specifically lint cotton after removal from the seed. The description that follows is based on the developmental context; however, description of the example system in terms of lint cotton in cotton ginning operations shall not be read as a limitation. The specification turns to a description of a portion of a cotton ginning operation to orient the reader.

FIG. 1 shows a schematic view of a portion of a cotton gin. In particular, visible in FIG. 1 is a batt condenser 100, a moisture conditioner 102, a lint slide 104, and a bale press 106. The batt condenser 100 in a cotton ginning operation condenses loose cotton fibers into a compact, continuous batt for easier handling and further processing. The example batt condenser 100 comprises a drum with a screen surface that rotates, and a negative pressure or vacuum is applied to the internal volume of the drum, as shown by duct 108 and arrow 110. Loose lint cotton 112 is convey or carried by airflow to the drum, and the drum captures fibers while allowing air to pass through. The collection and alignment of the loose lint cotton creates a batt. A doffer 114 dislodges the batt from the drum, and the batt of lint cotton falls onto a feed ramp 116 which feeds the moisture conditioner 102.

The example moisture conditioner 102 comprises a cylindrical drum 118 defined by a screen 120 with a plurality of apertures, such as apertures 122. The cylindrical drum 118 has a longitudinal central axis 124 that is perpendicular to the plane of the page of FIG. 1, and thus is shown as a point. The cylindrical drum 118 is configured to rotate in the direction shown about the longitudinal central axis 124. The moisture conditioner 102 further comprises a stationary component or moisture diffuser 126 positioned adjacent to and following the curvature of a portion of the cylindrical drum 118. The moisture diffuser 126 and the cylindrical drum 118 define an annular channel through which the batt of lint cotton flows or moves, with the movement in the same direction as the rotation of the cylindrical drum 118. The moisture conditioner 102 further includes a doffer in the example form of a fluted roller 128 in operational relationship to the cylindrical drum 118 and angularly displaced from the moisture diffuser 126. The fluted roller 128 is configured to dislodge the batt of lint cotton from the cylindrical drum 118.

The internal volume of the cylindrical drum 118 is fluidly coupled to a negative pressure or vacuum. The airflow created by the vacuum pulls the batt of lint cotton against the cylindrical drum 118. In the example of FIG. 1, the vacuum is applied to the internal volume of the cylindrical drum 118 by a fan or air pump 130 coupled to the cylindrical drum 118 by way of duct 132. In the example of FIG. 1, the exhaust airflow created by the air pump 130 is applied to the lint flue riser carrying the loose lint cotton 112 to the batt condenser 100, but such is not strictly required.

The example system of FIG. 1 further comprises a humidifier 134 as a humidified air source. As the name implies, the humidifier 134 generates a stream of warm, humid air or just moist air. The example humidifier 134 may comprise an air heater in which a gas or oil-fired burner operates with an open flame in the stream of air to be humidified. The stream of air passes through an air washer chamber in which a recirculated water spray scrubs the heated air, evaporating the water. The supply of moist air may be generated with an air temperature between 120 to 160 degrees F. dry-bulb temperature and 70 to 100% relative humidity. The humidifier 134 may be, for example, a HUMIDAIRE brand device manufactured by Samuel Jackson, Incorporated, of Lubbock, TX.

Still referring to FIG. 1, the moist air may be drawn from the humidifier 134 and supplied to the moisture conditioner 102 by way of a fan or air pump 136. In particular, the air pump 136 takes suction from the humidifier 134, and feeds the moist air to the plenum of the moisture diffuser 126. In example systems, the humidifier 134, air pump 136, and associated duct work may be designed and constructed to supply moist air at a velocity of between and including 1400 to 1700 feet per minute, in some cases between and including 1450 to 1650 feet per minute, and in a particular case about 1500 feet per minute. Metering valve 138 may be used to control the volume of moist air supplied, to between and including 2200 and 2500 cubic feet per minute. It follows, the internal volume of the moisture diffuser 126 carries positive pressure. The example system also comprises a heater 140 that makes warm, dry air in similar fashion to the humidifier 134. However, the warm, dry air created by the heater 140 is applied to the applicator and lint slide 104 when the system is cold in order to elevate the temperature of all surfaces that will be contacted by warm moist fiber. This pre-warming without moisture reduces condensation on the various surfaces and thus reduces fiber buildup during operation.

The moisture conditioner 102 adds moisture to the batt of cotton prior the batt of cotton being applied to the lint slide 104. In some cases, the moisture content of the lint cotton exiting the moisture conditioner 102 may be between and including 6.5% and 7.5%. In one example, the humidifier 134 and moisture conditioner 102 may add between and including 10 to 14 pounds of moisture per bale of lint cotton processed. The amount of moisture added is based on several factors, such as the initial moisture content of the lint cotton and ambient relative humidity at the location of the cotton gin.

Figure 2:
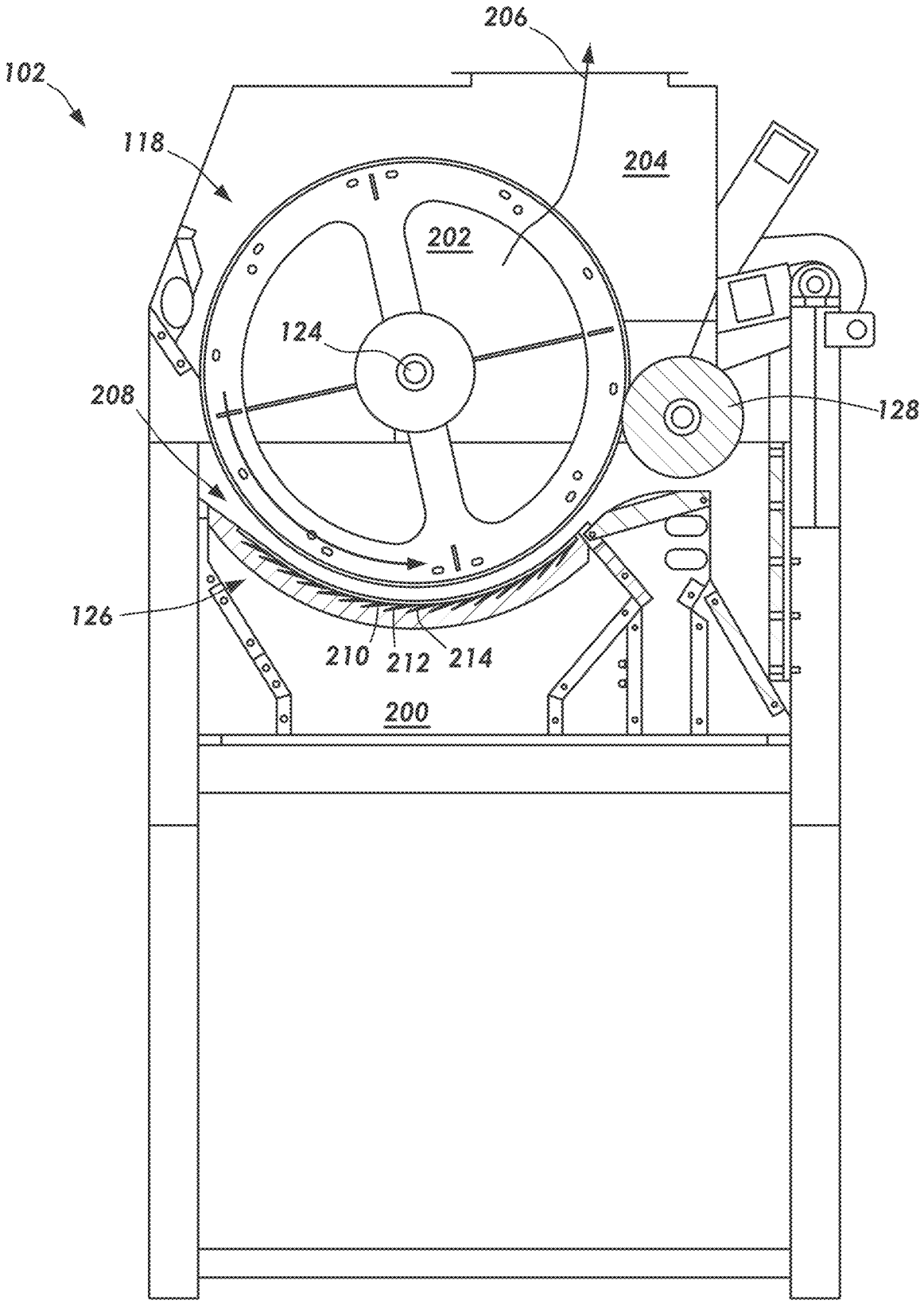
FIG. 2 shows a cross-sectional view of the example moisture conditioner.

FIG. 2 shows a simplified, cross-sectional schematic view of the example moisture conditioner 102. In particular, visible in FIG. 2 are the cylindrical drum 118, the fluted roller 128, the moisture diffuser 126, and the plenum 200 beneath the moisture diffuser 126. The internal volume 202 of the cylindrical drum 118 is fluidly coupled to an exhaust plenum 204, and the exhaust plenum 204 is fluidly coupled to the air pump 130 (FIG. 1) by way of duct 132 (FIG. 1). Thus, airflow created by the vacuum pulls air from the internal volume 202, into the exhaust plenum 204, and out to the air pump 130, as shown by the arrow 206. The airflow created by the vacuum pulls the batt of lint cotton (not specifically shown in FIG. 2) against the cylindrical drum 118.

In one example, the cylindrical drum 118 has a 43-inch diameter (1.09 meter) and an exterior surface screen that defines a right circular cylinder. The surface of cylindrical drum 118 may be formed from 16-gauge stainless steel punched with 3/16 inch diameter (4.76 mm) holes staggered on ¼-inch (6.35 mm) centers, resulting in a 51% open area through which air may pass. Other hole sizes, spacing, and open area may be used.

An adjustable frequency drive package (not specifically shown) controls the surface speed of cylindrical drum 118 in relation to the surface speed of the batt condenser 100. In particular, the cylindrical drum 118 rotates five to ten percent faster than the screen of the batt condenser 100 in order to pull the batt of lint cotton into moisture conditioner 102. If cylindrical drum 118 rotates at an equal or lesser speed than the batt condenser, the batt of lint cotton tends to bunch up before reaching cylindrical drum 118, thereby creating the possibility of blockage.

Still referring to FIG. 2, the moisture conditioner 102 comprises the moisture diffuser 126 that is stationary. The moisture diffuser 126 is positioned adjacent to the cylindrical drum 118, and the moisture diffuser 126 has a curvature that is complementary to the curvature of the cylindrical drum 118. In the example of FIG. 2, the moisture diffuser 126 covers less than half the circumferential distance around the cylindrical drum 118, and in some cases about a quarter of the circumferential distance around the cylindrical drum 118. The combination of the cylindrical drum 118 and moisture diffuser 126 define an annular channel 208 into which the batt of lint cotton is fed. The cylindrical drum 118 turns in the direction shown, and correspondingly the batt of lint cotton moves in the annular channel 208 in the same direction. Thus, the annular channel 208 defines the path of travel for the batt of lint cotton.

The example moisture diffuser 126 comprises a plurality of louvers or slats, such as example slats 210, 212, and 214. Each slat has a long dimension parallel to the longitudinal central axis 124. In the view of FIG. 2, the longitudinal central axis 124 is perpendicular to the plane of the page; thus, in FIG. 2 the long dimension of each slat is likewise perpendicular to the plane of the page. Moreover, each slat has a width measure measured perpendicular to the length. In some cases, the width may be between and including three inches and five inches, and in a particular case four inches. The slats may have a thickness of between and including 12 gauge (0.109 inches) and 14 gauge (0.078 inches).

In the example of FIG. 2, seventeen slats are present, each at a distinct angular position; however, any suitable number of slats may be used. As is shown and discussed in greater detail below, adjacent slats define a flow nozzle and thus a flow channel through the slats, and the slats considered as a group define a plurality of flow nozzles. For example, adjacent slats 210 and 212 define a flow nozzle, though the flow nozzle is not visible in the scale of FIG. 2. Similarly, slat 210 and the adjacent to the left of slat 210 define a flow nozzle. Slat 212 and the adjacent slat 214 define a flow nozzle. The flow nozzles are designed and constructed to direct airflow into the annular channel 208. More particularly, the flow nozzles are designed and constructed to direct the moist air within the plenum 200 into the annular channel 208. Each flow nozzle resides at a distinct angular location or angular position relative to the annular channel 208, and each flow nozzle directs airflow into the annular channel 208 approximately along a tangent to the annular channel 208 at the location of the flow nozzle.

Thus, the moist air enters the batt of lint cotton substantially along the path of travel of the lint cotton. Eventually, the moist air is pulled into the cylindrical drum 118; however, having the moist air enter the batt of lint cotton substantially along the path of travel is believed to increase the contact time of the moist air with the lint cotton, particularly compared to related-art device in which the moist air enter the lint cotton substantially perpendicular to the path of travel of the lint cotton.

Figure 3A:
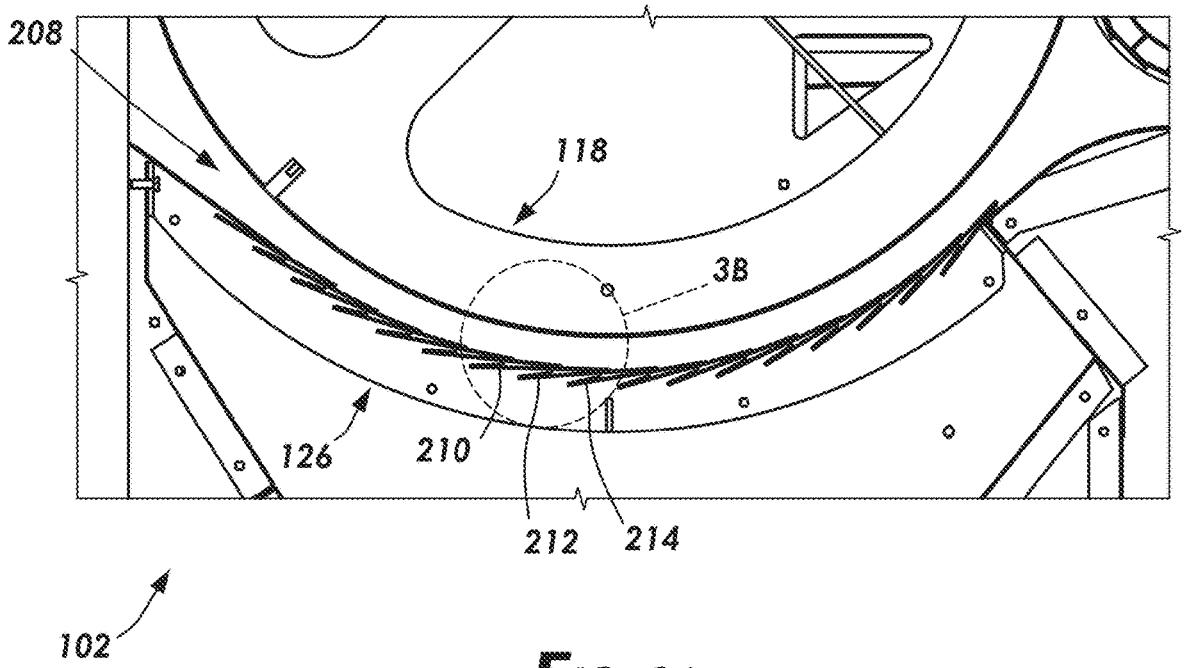
FIG. 3A shows a more detailed cross-sectional view of the moisture conditioner.
Figure 3B:
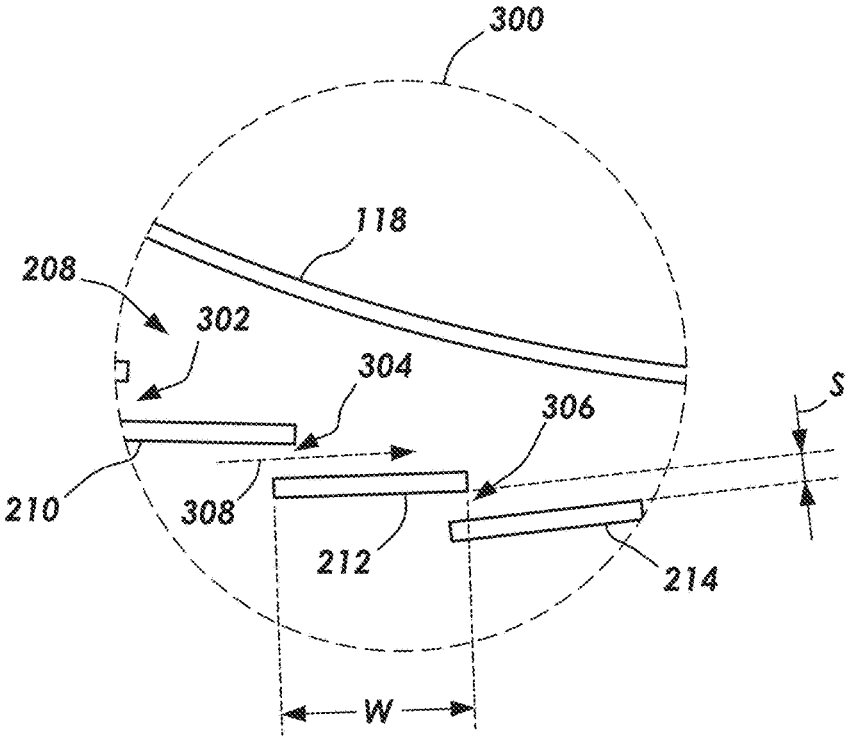
FIG. 3B shows a more detailed cross-sectional view of the moisture conditioner.

FIG. 3A shows a more detailed cross-sectional view of the moisture conditioner 102. In particular, visible in FIG. 3A is a portion of the cylindrical drum 118 along with the moisture diffuser 126. As before, the cylindrical drum 118 and moisture diffuser 126 define the annular channel 208. The moisture diffuser 126 comprises the plurality of louvers or slats, such as slats 210, 212, and 214. FIG. 3B is a magnified section 300 of the moisture conditioner 102. Visible in the magnified section 300 is a portion of the cylindrical drum 118, the slats 210, 212, and 214, and the annular channel 208 defined between the slats.

The magnified section 300 if FIG. 3B shows three example flow nozzles. In particular, flow nozzle 302 is defined by slat 210 and the adjacent slat the left. Flow nozzle 304 is defined by slats 210 and 212. Flow nozzle 306 is defined by slats 212 and 214. Focusing on flow nozzle 304 as representative, the flow nozzle 304 is designed and constructed to direct the moist air into the annular channel 208. More particularly, in various examples each flow nozzle is designed and constructed to direct airflow into the annular channel 208 substantially tangent to the annular channel at the angular position of the flow nozzle. Focusing again on flow nozzle 304 as representative, flow nozzle 304 directs airflow into the annular channel 208 as shown by dashed line 308. In some cases, the direction of airflow is tangent to the annular channel. In other cases, the airflow may be between and including tangent to the annular channel 208 and minus ten (−10) angular degrees with respect to the tangent (e.g., minus five), with negative directions more toward the longitudinal central axis 124 (not visible). Stated in terms of slat placement, in some examples each slat resides substantially along a tangent to the annular channel at the annular location where the slat meets the annular channel. In other cases, each slat may be placed between and including tangent to the annular channel 208 and minus ten (−10) angular degrees with respect to the tangent (e.g., minus five), with negative directions more toward the longitudinal central axis 124 (not visible in FIG. 3).

Each flow nozzle is thus defined by two adjacent slats. More particularly, each flow nozzle is defined by at least the overlapping portions of adjacent slats. Each flow nozzle has a cross-sectional flow area defined by separation between the slats and the length of the slats. Referring to flow nozzle 306 as representative, flow nozzle 306 is defined by slats 212 and 214. Slats may be between 35 and 65 inches in length, in some cases between and including 40 and 60 inches. The example slats 212 and 214 define a separation S measured perpendicularly from the downstream slat 214 to the closest point of the upstream slat 212. The separation S between each slat may be between and including ⅛ inch and ¾ inch, depending upon the length of the slats and the designed airflow rate. The example system has 17 slats, and thus define 16 flow nozzles. In one example, the total cross-sectional flow area for the plurality of flow nozzles may be between and including 1.0 and 2.0 square feet, and in a particular case about 1.5 square feet.

Figure 4:
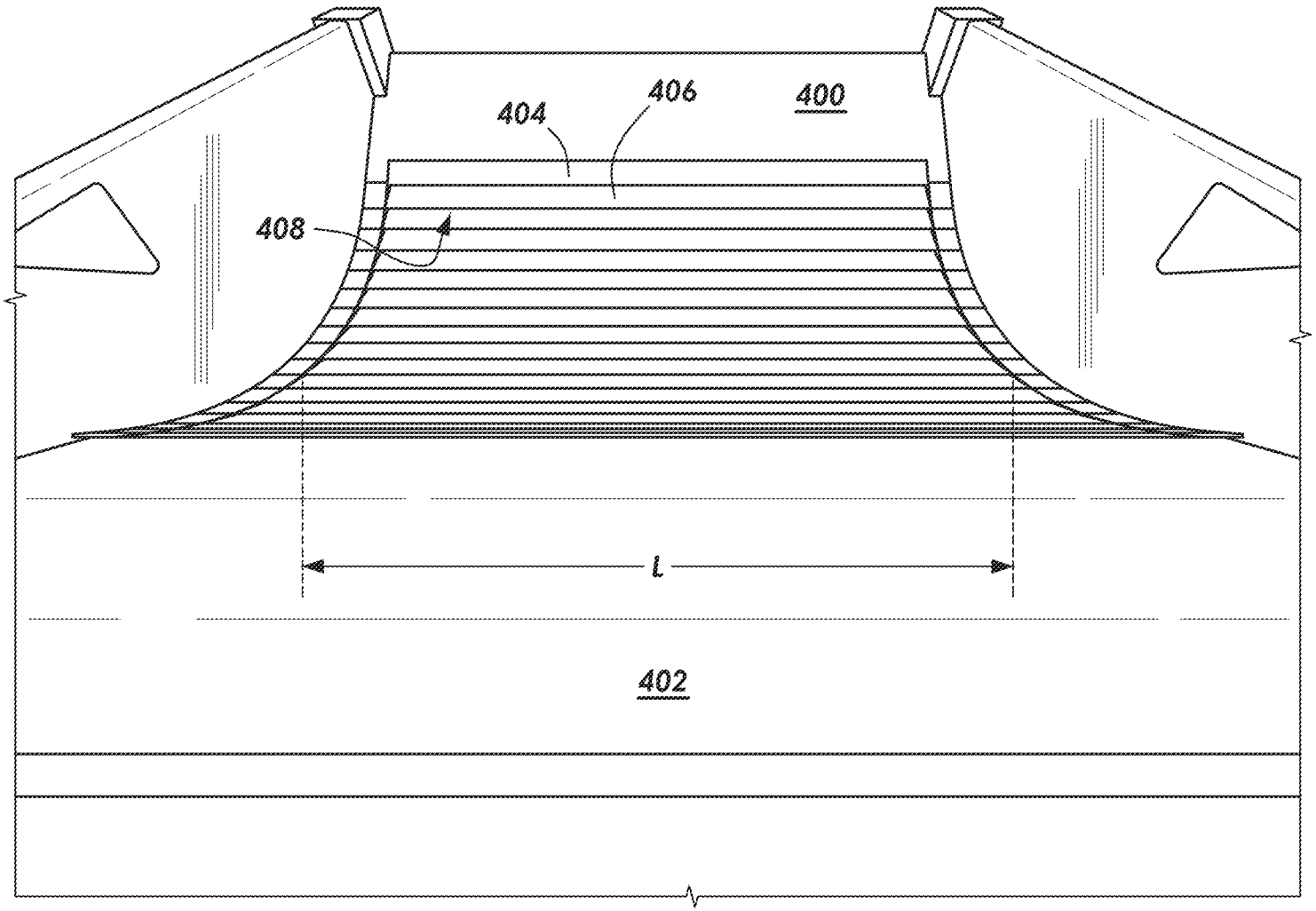
FIG. 4 shows a perspective view of the example moisture diffuser of the moisture conditioner.

FIG. 4 shows a perspective view of the example moisture diffuser 126. In particular, visible in FIG. 4 is the entrance platen 400 and the exit platen 402. The bat of lint cotton from the batt condenser 100 (not shown) is fed to the entrance platen 400 to enter the annular channel 208 (not visible). Likewise, the batt of lint cotton exiting the moisture conditioner 102 exits to the lint slide 104 (not shown) by way of the exit platen 402. Between the entrance platen 400 and the exit platen 402 resides the louvers or slats, such as slats 404 and 406. Defined between slat 404 and 406 is another example a flow nozzle 408. Each slat defines a length L between and including 35 to 65 inches, and in some cases between and including 40 to 60 inches.

Figure 5:
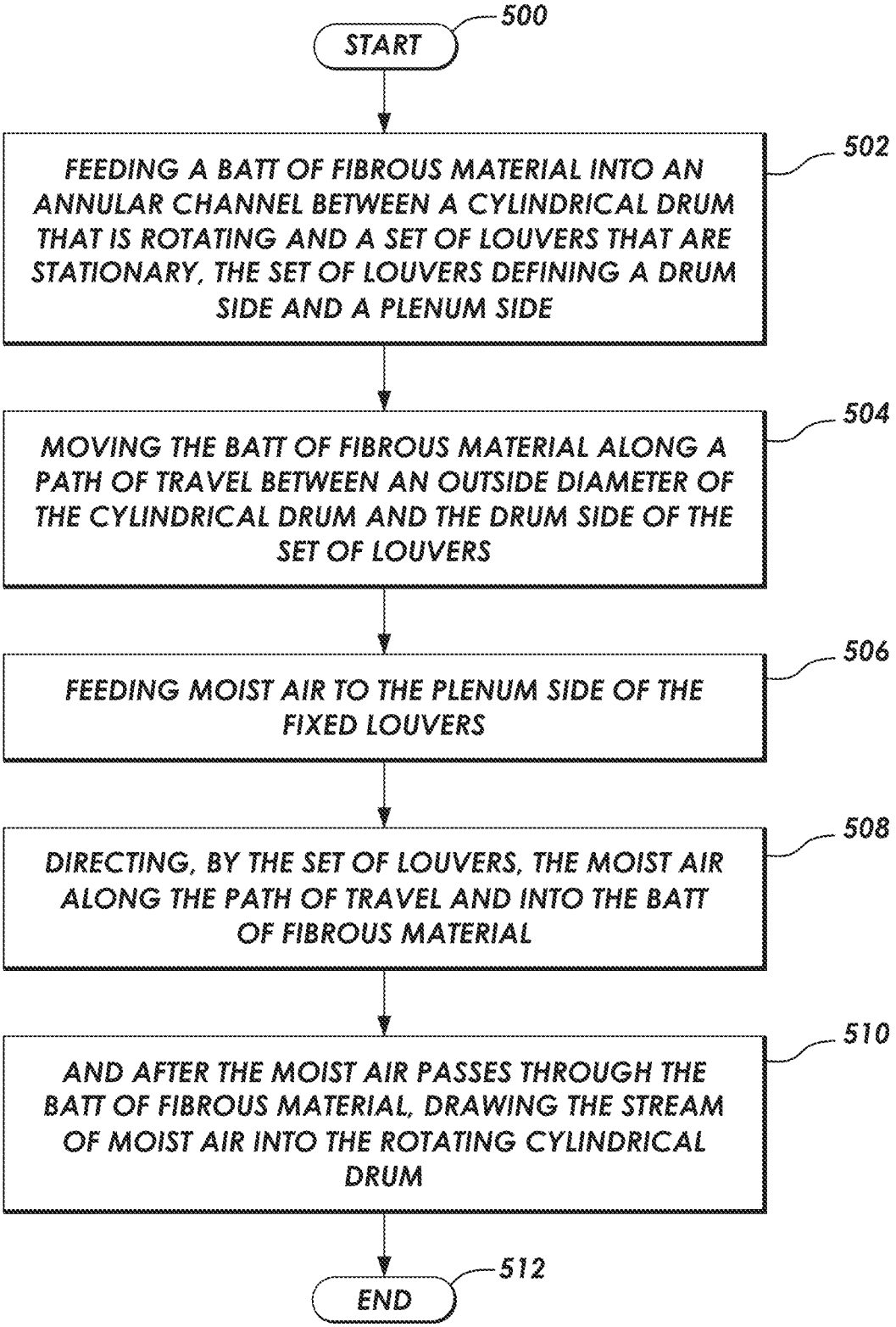
FIG. 5 shows an example method.

FIG. 5 shows an example method of supplying moisture to fibrous material. In particular, the method starts (block 500) and comprises: feeding a batt of fibrous material into an annular channel between a cylindrical drum that is rotating and set of louvers that are stationary, the set of louvers defining a drum side and a plenum side (block 502); moving the batt of fibrous material along a path of travel between an outside diameter of the cylindrical drum and the drum side of the set of louvers (block 504); feeding moist air to the plenum side of the set of louvers (block 506); directing, by the set of louvers, the moist air along the path of travel and into the batt of fibrous material (block 508); and the moist air passes through the batt of fibrous material drawing the stream of moist air into the rotating cylindrical drum (block 510). Thereafter the method ends (block 512) with the understanding the process may be continuous during cotton ginning operations.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A moisture conditioner apparatus comprising:

a cylindrical drum defined by a screen with a plurality of apertures, the cylindrical drum having a longitudinal central axis and configured to rotate about the longitudinal central axis;

a moisture diffuser positioned adjacent to a portion of the cylindrical drum, wherein the moisture diffuser and the cylindrical drum define an annular channel;

the moisture diffuser comprises a plurality of slats, each slat having a long dimension parallel to the longitudinal central axis;

a plurality of flow nozzles, each flow nozzle formed between adjacent slats, and each flow nozzle configured to direct airflow into the annular channel;

a doffer in operational relationship to the cylindrical drum and angularly displaced from the moisture diffuser, the doffer configured to dislodge a batt of fibrous material from the cylindrical drum;

wherein each flow nozzle resides at a distinct angular location relative to the annular channel, and each flow nozzle directs airflow into the annular channel along a tangent to the annular channel at each respective angular location.

2. The moisture conditioner apparatus of claim 1 further comprising an air pump and a suction plenum associated with the cylindrical drum, the air pump and suction plenum configured to place an internal volume of the cylindrical drum under vacuum.

3. The moisture conditioner apparatus of claim 1 further comprising a humidified air source configured to provide the humidified air to the moisture diffuser.

4. The moisture conditioner apparatus of claim 1 wherein a cross-sectional flow area of the plurality of flow nozzles is between and including 1.0-2.0 square feet.

5. The moisture conditioner apparatus of claim 1 wherein each slat of the plurality of slats has a length of between and including 35 to 65 inches.

6. The moisture conditioner apparatus of claim 1 wherein each slat of the plurality of slats has a length of between and including 40 to 60 inches.

7. The moisture conditioner apparatus of claim 1 wherein the apparatus is coupled between a batt condenser and a lint slide.

8. A moisture conditioner apparatus comprising:

a cylindrical drum defined by a screen with a plurality of apertures, the cylindrical drum having a longitudinal central axis and configured to rotate about the longitudinal central axis;

a moisture diffuser positioned adjacent to a portion of the cylindrical drum, wherein the moisture diffuser and the cylindrical drum define an annular channel;

the moisture diffuser comprises a plurality of slats, each slat having a long dimension parallel to the longitudinal central axis;

a plurality of flow nozzles, each flow nozzle formed between adjacent slats, and each flow nozzle configured to direct airflow into the annular channel;

a doffer in operational relationship to the cylindrical drum and angularly displaced from the moisture diffuser, the doffer configured to dislodge a batt of fibrous material from the cylindrical drum;

wherein each flow nozzle resides at a distinct angular location relative to the annular channel, and each flow nozzle directs airflow into the annular channel in a direction between and including tangent to the annular channel and minus ten (−10) angular degrees with respect to the tangent at each respective angular location.

9. The moisture conditioner apparatus of claim 8 further comprising a humidified air source configured to provide the humidified air to the moisture diffuser.

10. The moisture conditioner apparatus of claim 8 wherein a cross-sectional flow area of the plurality of flow nozzles is between and including 1.0-2.0 square feet.

11. The moisture conditioner apparatus of claim 8 wherein each slat of the plurality of slats has a length of between and including 35 to 65 inches.

12. The moisture conditioner apparatus of claim 8 wherein each slat of the plurality of slats has a length of between and including 40 to 60 inches.

13. The moisture conditioner apparatus of claim 8 wherein the apparatus is coupled between a batt condenser and a lint slide.

14. A moisture conditioner apparatus comprising:

a cylindrical drum defined by a screen with a plurality of apertures, the cylindrical drum having a longitudinal central axis and configured to rotate about the longitudinal central axis;

a moisture diffuser positioned adjacent to a portion of the cylindrical drum, wherein the moisture diffuser and the cylindrical drum define an annular channel;

the moisture diffuser comprises a plurality of slats parallel to each other, each slat having a long dimension parallel to the longitudinal central axis, and each slat having a width;

the width of each slat defines a direction coaxial with a tangent of the annular channel or the cylindrical drum;

a plurality of flow nozzles, each flow nozzle formed between adjacent slats;

a fluted roller in operational relationship to the cylindrical drum and angularly displaced from the moisture diffuser, the fluted roller configured doff a batt of fibrous material from the cylindrical drum.

15. The moisture conditioner apparatus of claim 14 further comprising a humidified air source configured to provide the humidified air to the moisture diffuser.

16. The moisture conditioner apparatus of claim 14 wherein a cross-sectional flow area of the plurality of flow nozzles is between and including 1.0-2.0 square feet.

17. The moisture conditioner apparatus of claim 14 wherein each slat of the plurality of slats has a length of between and including 35 to 65 inches.

18. The moisture conditioner apparatus of claim 14 wherein each slat of the plurality of slats has a length of between and including 40 to 60 inches.

19. The moisture conditioner apparatus of claim 14 wherein the apparatus is coupled between a batt condenser and a lint slide.

* * * * *